United States Patent [19]

Jacobsson

[11] 4,444,314

[45] Apr. 24, 1984

[54] STORING DEVICE FOR FLAT OBJECTS

[76] Inventor: Carl L. Jacobsson, Bellmansgatan 11, Göteborg S-411 28, Sweden

[21] Appl. No.: 396,607

[22] Filed: Jul. 9, 1982

[30] Foreign Application Priority Data

Jul. 31, 1981 [SE] Sweden ..... 8104637

[51] Int. Cl.[3] ..... B65D 85/00

[52] U.S. Cl. ..... 206/425; 206/45; 206/311

[58] Field of Search ..... 206/45, 311, 425, 494, 206/472

[56] References Cited

U.S. PATENT DOCUMENTS

| | | | |
|---|---|---|---|
| 490,156 | 1/1893 | Miller | 206/45 |
| 1,021,598 | 3/1912 | Harrington | 206/425 |
| 1,238,074 | 8/1917 | Labadie et al. | 206/45 |
| 1,424,780 | 8/1922 | Sea | 206/311 |

FOREIGN PATENT DOCUMENTS

| | | | |
|---|---|---|---|
| 367389 | 1/1923 | Fed. Rep. of Germany | 206/311 |
| 26433 | of 1914 | United Kingdom | 206/311 |

*Primary Examiner*—Joseph Man-Fu Moy
*Attorney, Agent, or Firm*—Fred Philpitt

[57] ABSTRACT

In a device for storing flat objects, especially cards, the interior of an outer casing is divided into a plurality of compartments by means of a series of structurally identical, interconnected pockets. From storing positions, in which all of the pockets are located straight behind one another, they are movable into stepped, partly exposed positions, in which each pocket behind projects beyond the adjacent pocket in front a predetermined distance to permit easy access to the various pockets. Limited relative slidability of adjacent pockets is achieved by tab-in-slit connections between them in a manner to facilitate their assembly.

4 Claims, 13 Drawing Figures

STORING DEVICE FOR FLAT OBJECTS

FIELD OF INVENTION

This invention relates to a device for storing flat objects, especially cards and so-called microfiches of uniform size, in a series of compartments, one for each single object or a small group of objects, which device, although affording satisfactory protection for the objects stored therein, permits easy insertion and removal of the objects into and from their selected compartments.

More specifically the invention is concerned with a storing device of the kind just defined, in which each compartment consists of an open pocket formed by folding a generally rectangular blank of a thin but stiff sheet material and having a rear wall portion and a front wall portion, the rear wall portion having a height exceeding that of the front wall portion, and in which the series of pockets is held together in such manner that from storing positions, in which all pockets are located straight behind one another, they are movable into stepped, partly exposed positions, in which each pocket behind projects in the direction of the pocket openings beyond the adjacent pocket in front a predetermined distance at least approximately corresponding to the difference in height between the rear and front wall portions of each pocket.

THE PRIOR ART

A storing device for the same purpose and generally of the kind just defined is disclosed in the German Offenlegungsschrift DE 30 02 748. In this previously known device all the pockets, although generally of the same size, are differently shaped and loosely rested, one upon the other, on a special kind of supporting tray. This makes the production of the pockets fairly difficult and expensive. In addition, special care must be taken in assembling the pockets in their correct order, because otherwise they will not operate properly in the device. Furthermore, the number of pockets in each device is limited, because the rearmost pocket in the series must never come entirely outside of the tray in its partly exposed position. Still further, in the previously known device the objects to be stored may easily be inserted between the pockets instead of into them, because there is nothing to prevent such mistakes, and the actual pocket length always has to exceed the maximum object length at least to a certain extent, because the means for controlling the movements of the various pockets are located and made to cooperate with the opposite, extreme outer end portions of the pockets in the series.

In this connection it should be mentioned that interconnecting a plurality of uniform members, one to the next, generally in the fashion of an extensible chain is old per se. Thus, according to the Swedish Patent Publication No. 304,619, this basic conception has been used for making possible a survey of all the pictures of a selected series of framed diapositives. However, in this case each framed diapositive is retained in a rigid holder made of sheet metal or molded plastic, and adjacent holders are interconnected by means of hooklike guiding members embracing lateral flanges on the adjoining holder. Accordingly, the holders are difficult and expensive to produce and cannot be widened to facilitate insertion and removal of the objects to be stored. In addition, in the lateral direction the size of each holder must significantly exceed the size of the object, and in placing the interconnected holders in a box special care is needed for preventing the hooklike guiding members of the holders from getting stuck.

SUMMARY OF THE INVENTION

The aim of this invention is to provide a novel and improved storing device of the kind first referred to hereinbefore in which the drawbacks and limitations of the prior art just described are eliminated. In particular, it is an object of the invention to simplify the production and the assembly of the pockets of the device, and to make it possible to use any desired number of pockets of one single design in devices of different storing capacities.

This is mainly achieved by providing a storing device of the kind first referred to hereinbefore, wherein said pockets are structurally identical and slidably interconnected, one to the next, in a manner to limit the relative slidability of adjacent pockets to said predetermined distance, said interconnection between adjacent pockets being provided by means of interengaging tabs and slits formed in the rear wall portion of the pocket in front and in the front wall portion of the pocket behind, and the front wall portion of the foremost pocket in the series being connected to a fore guide member forming part of a casing enclosing the series of pockets in their storing positions.

Further objects and features of the invention will become apparent from the description of an embodiment of the same following hereinafter.

BRIEF DESCRIPTION OF THE DRAWINGS

A comprehensive embodiment of the invention selected mainly for illustrative purposes is shown on the accompanying drawings, in which.

DESCRIPTION OF THE ILLUSTRATED EMBODIMENT

Figure 3:
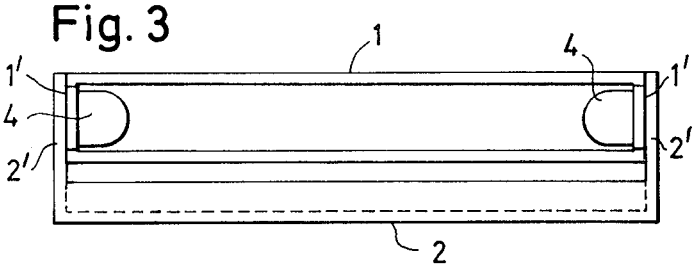
FIG. 3 is a top view of the box only of the storing device, the lid thereof being open but the box being empty.
Figure 4:
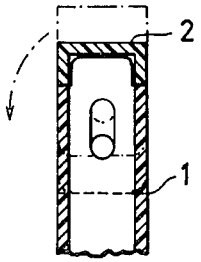
FIG. 4 is a fragmentary sectional elevation showing the upper portion of the box with its lid in closed position, the steps needed to open the lid being indicated.

The storing device illustrated in the drawings comprises a generally rectangular box 1 having fairly small width in relation to its length and height. The box proper is open at its top and has a lid 2 which by means of end wall extensions or shanks 2' having pegs on their inner sides is hingedly connected to slotted upper end wall portions 1' of the box 1 in such manner that after having been lifted a short distance from its seat (FIG. 4) the lid 2 can be tilted forwards or backwards to a position of rest (FIGS. 1–3), in which it is entirely out of the way without being detached from the box. Near its bottom the box 1 is provided with slits 3 in its end walls, through which flat locking dowels 4 can be inserted for retaining in the box an insert unit to be more closely described in the following. The dowels 4 may afterwards be fixed in the slots 3 by adhesive, if so desired. The box 1 and its lid 2 may be molded in plastic, and the dowels 4 may be cut out from a plate of plastic, for example.

It is to be noted, however, that, although the use of a box of the type just described is very convenient, the invention may equally well be applied to storing devices having a protective outer casing of an entirely different design, possibly without a lid and even without a bottom member, in which the insert unit is retained in any other desired way than by the use of dowels as shown. As a matter of fact, if it is desirable to produce a very inexpensive storing device, the casing may be reduced to only a simple wrapping attached by adhesive directly to the insert unit.

Figure 1:
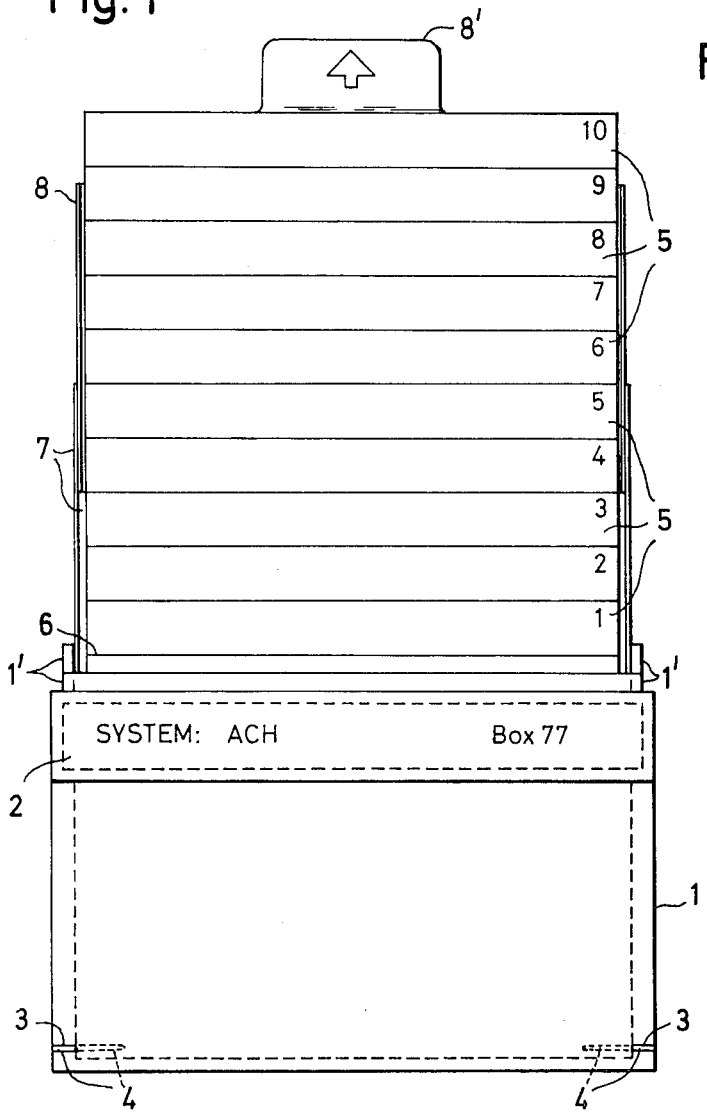
FIG. 1 is a front view of a storing device for so-called microfiche cards, the lid of the box being open and the card receiving pockets being elevated into their partly exposed positions.
Figure 2:
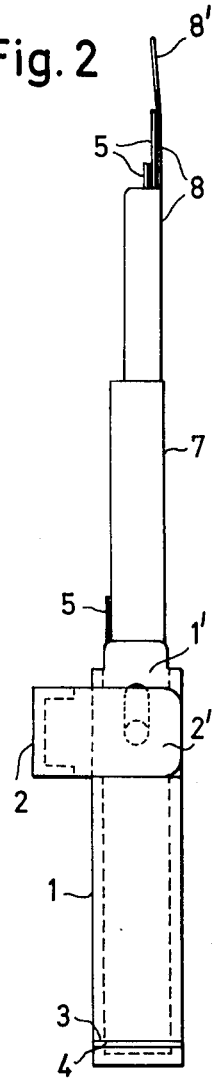
FIG. 2 is a side view showing the storing device as seen from the right in FIG. 1.

The insert unit forming part of the storing device shown in FIGS. 1 and 2 first of all comprises a series of pockets 5, ten in the example illustrated, which are all of identical design and which form compartments for the objects to be stored. In addition thereto the insert unit comprises a casing member 6, an intermediate coupling member 7, and a slide member 8. The design of these components and how they are interconnected will now be more closely described with reference to FIGS. 5 to 13 inclusive.

Figure 7:
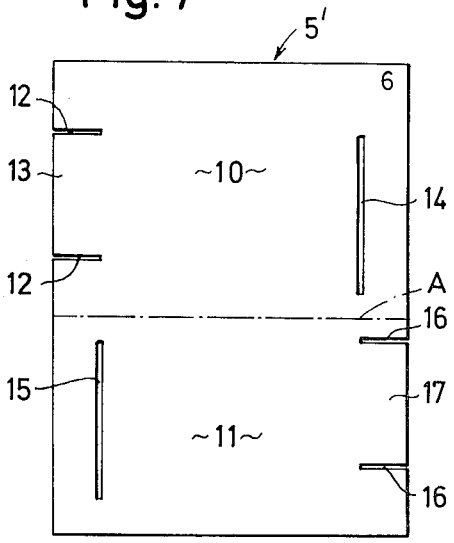
FIG. 7 is a plan view on a reduced scale of a blank for forming a pocket of the kind used in the storing device.
Figure 8:
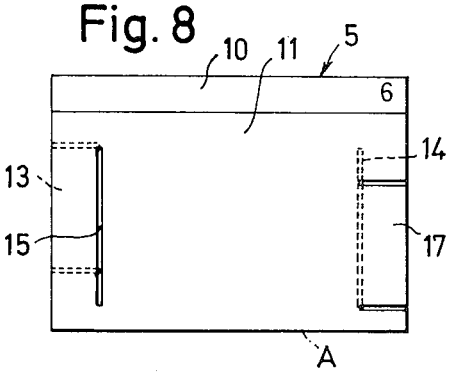
FIG. 8 is a front view of a pocket formed from the blank of FIG. 7.

In FIG. 7 a pocket blank 5' made of cardboard or other sheet material is shown, which is generally rectangular in shape and which by being folded along the dash-and-dot line A forms an open-ended pocket 5, as illustrated in FIG. 8, having a rear wall portion 10 and a front wall portion 11, the height of which is somewhat smaller than that of the rear wall portion 10. In its one lateral edge the rear wall portion 10 has a pair of vertically spaced incisions 12 forming between them a tab 13, and in the vicinity of its opposite lateral edge it has a slit 14 extending parallel thereto. The front wall portion 11 on the other hand has a slit 15 extending in the vicinity of and parallel to the one lateral edge thereof which coincides with the edge of the rear wall portion 10 where the tab 13 is formed, whereas the opposite lateral edge of the front wall portion has two vertically spaced incisions 16 forming between them a tab 17. The tabs 13 and 17 are of the same size, but in the completed pocket 5 (FIG. 8) they are vertically displaced relative to each other a distance corresponding to the desired freedom of relative vertical movement of two adjacent pockets 5 in the series of pockets of the insert unit.

Figure 9:
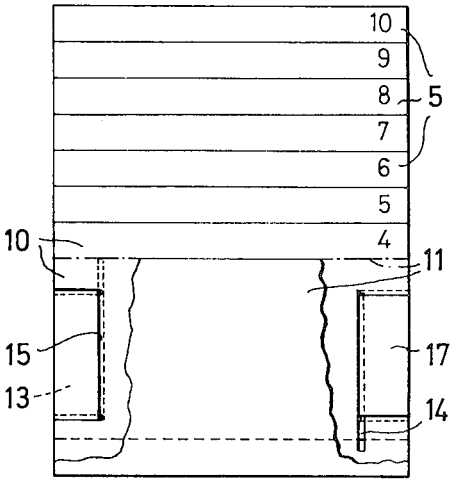
FIG. 9 is a front view of a yet incomplete pulled out series of interconnected pockets also indicating the manner in which adjacent pockets are coupled together.

Thanks to this pocket design, any desired number of pockets may be coupled together in succession, one to the next, by being mutually moved in a lateral direction in such manner that the tab 13 on the rear wall portion 10 of the pocket in front is received from in front in the slit 15 in the front wall portion 11 of the pocket next behind, while at the same time the tab 17 on the front wall portion of the pocket next behind is received from behind in the slit 14 in the rear wall portion of the pocket in front. This will result in a slidable interconnection of adjacent pockets substantially as illustrated in FIG. 9.

Figure 5:
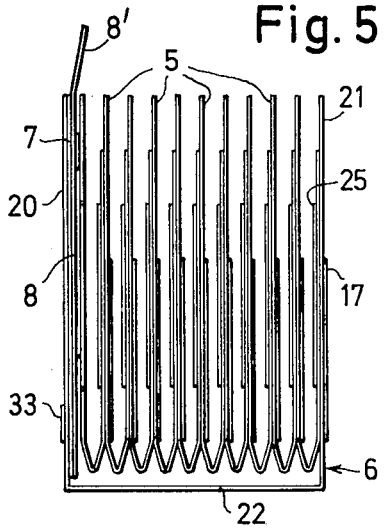
FIG. 5 is a slightly diagrammatic side view of an insert unit housed in the box of the storing device and containing among other things the pockets for the cards to be stored, said pockets being shown in a slightly widened condition and in their storing positions.
Figure 6:
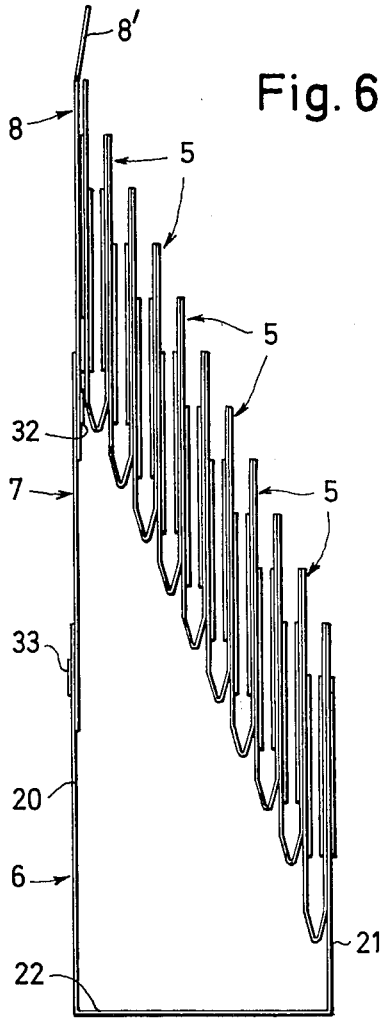
FIG. 6 is a side view similar to that of FIG. 5 but showing the pockets in their elevated, partly exposed positions.
Figure 10:
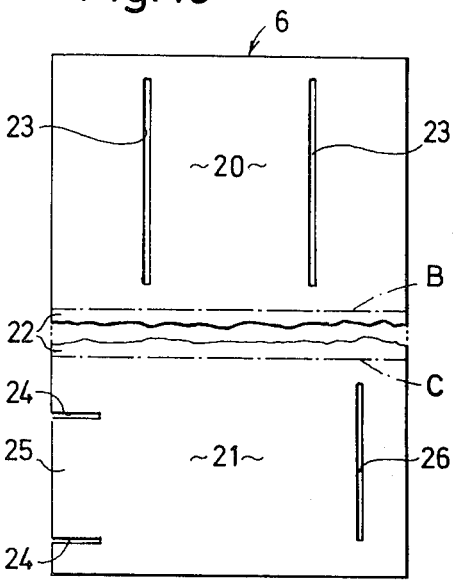
FIG. 10 is a plan view, likewise on a reduced scale, of a blank for a casing member, this member being formed by folding the blank into U-shape, such as shown in FIGS. 5 and 6.

The casing member 6 also consists of a generally rectangular blank of cardboard or other sheet material as illustrated in FIG. 10. By being folded along the two lines B and C this flat blank may be erected into U-shape, as shown in FIGS. 5 and 6. When so erected the casing member 6 presents a rear wall portion 20 and a front wall portion 21 connected by a bottom wall portion 22, the size of which is selected to fit the internal width of the box 1 with a certain clearance. The two wall portions 20 and 21, which are both of a size slightly exceeding that of the rear wall portions 10 of the pockets 5, form a kind of guides, a rear one and a fore one, of which the rear one 20 is provided with two parallel, vertically extending slits 23, the purpose of which will appear from the following, whereas the fore one 21 has a pair of incisions 24 in its one lateral edge forming between them a tab 25, and in the vicinity of its opposite lateral edge has a slit 26 extending parallel thereto. The tab 25 and the slit 26 in the erected front wall portion 21 of the casing member 6 closely correspond to the tab 13 and the slit 14 in the rear wall portion 10 of each pocket 5, which means that the front wall portion 21 can easily be slidably coupled together with the front wall portion 11 of the first or foremost pocket 5 of the insert unit in exactly the same manner as each pocket is coupled to the adjacent one in the pocket series, hence to permit a limited elevation of said first pocket in relation to the casing member 6 (see FIGS. 1 and 6).

Figure 11:
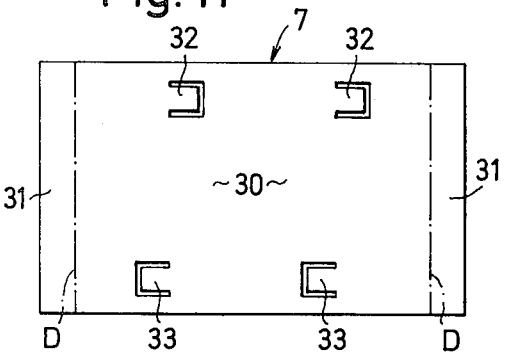
FIG. 11 is a plan view, likewise on a reduced scale, of a blank for a coupling member forming part of the insert unit.

The coupling member 7 is formed from a blank illustrated in FIG. 11, which consists of a rectangular piece of cardboard or other, relatively stiff sheet material. It has approximately the same height as the rear wall portion 10 of each pocket 5, but its length exceeds that of the pocket so as to form flap portions 31 on opposite lateral sides of a central portion 30. These two flap portions 31 are folded forwards each along a folding line D, whereby the blank is formed into the chute-like coupling member 7. The distance between the two folding lines D slightly exceeds the length of each pocket 5. Two pairs of ears 32 and 33, respectively, are cut out in the central portion 30 of the blank, the ears 32 being disposed in the vicinity of the upper edge of the blank and extending in opposite lateral direction to the ears 33 which are disposed in the vicinity of the lower edge of the blank. The two lower ears 33 are adapted to be inserted from in front in the two slits 23 of the rear wall portion 20 of the casing member 6 (FIG. 10), whereby the coupling member 7 will be guided by said casing member and be vertically slidable relative to the same within certain limits in order to serve as a kind of expansion element as will more closely appear from the following.

Figure 12:
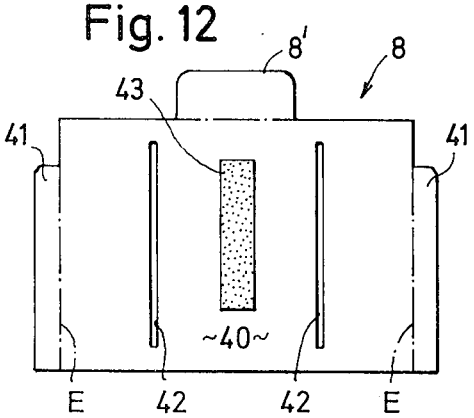
FIG. 12 is a plan view, likewise on a reduced scale, of a blank for a slide member forming part of the insert unit of the storing device shown in FIGS. 1 and 2.

The slide member 8 shown in FIG. 12, which is also made of cardboard or other sheet material, has a central portion 40 from the upper edge of which a foldable grip tab 8' projects and the lateral edges of which have flap portions 41 to be folded forwards along their respective folding lines E. The height of the central portion 40 approximately equals the height of the rear wall portion 10 of each pocket 5, and the distance between the folding lines E slightly exceeds the length of each pocket. In their forwardly folded positions the flap portions 41 form lateral guides for at least the rearmost ones of the pockets 5, and they have their outer faces in sliding contact with the inner faces of the flap portions 31 of the coupling member 7. The central portion 40 of the slide member 8 has a pair of parallel, vertical slits 42 in which the upper ears 32 of the coupling member 7 are to be inserted from behind, whereby the slide member will be slidable a limited distance relative to the coupling member in contact with the front face thereof. In this manner the slide member 8, through the intermediation of member 7, will be indirectly coupled to and guided by the rear wall portion 20 of the casing member 6 in such manner that it may be elevated a distance equal to the distance covered by the rearmost pocket 5 of the insert unit.

Figure 13:
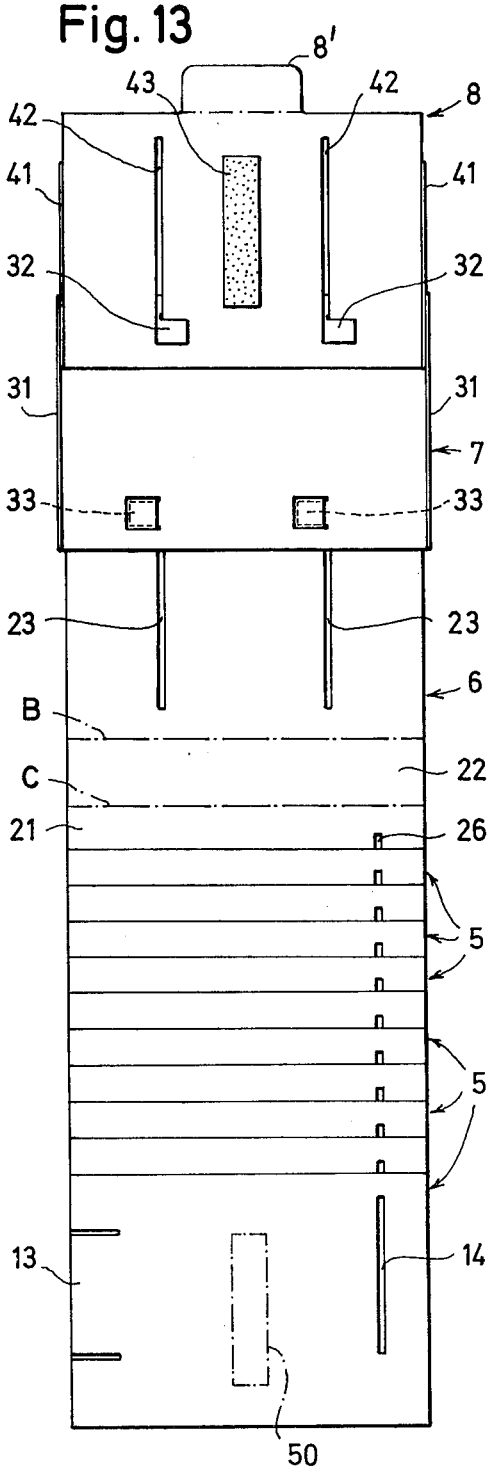
FIG. 13 is a plan view showing all the various members of the insert unit in their pulled out relative positions and before said unit is finally erected for being inserted in the box.

Now, when the ten pockets 5 have been coupled to one another and to the front wall portion 21 of the casing member 6, and when also the slide member 8 and the intermediate coupling member 7 have been coupled to one another and to the rear wall portion 20 of the casing member 6 there is achieved an assembly which, if the various members thereof occupy their pulled out position relative to each other, has the appearance illustrated in FIG. 13. After subsequent erection of the casing member 6 along the folding lines B and C, this assembly will form a complete insert unit, in which the front face of the slide member 8 abuts the rear face of the rear wall portion 10 of the rearmost pocket 5. A piece 43 of double-faced adhesive tape attached to the front face of the slide member 8 is caused to adhere to a corresponding surface area 50 (FIG. 13) on the rear face of the rear wall portion of the rearmost pocket 5 in order to secure the slide member to said pocket. It is hereby assured that the assembled unit members, provided that they have been coupled together in the manner shown and described, can no longer slide apart laterally. Thus the insert unit is ready to be inserted in the box 1 and to be fixed therein by means of the dowels 4, which are inserted between the bottom wall portion 22 of the casing member 6 and the lower ends of the pockets 5.

It is important, of course, to see to it that the connection between the slide member 8 and the rearmost pocket 5 does not hazard the movability of the slide members 8 relative to the coupling members 7. Likewise it is important that the completed insert unit is retained in the box 1 in such manner that the limited movability between the foremost pocket 5 and the front wall portion 21 of the casing member 6 as well as between the coupling member 7 and the rear wall portion 20 of the casing member 6 is fully maintained.

From FIGS. 5 and 6 it clearly appears, how the pockets 5 of the insert unit are movable between a storing position, FIG. 5, in which they are located straight behind one another, and a partly exposed position, FIG. 6, in which they occupy stepped elevated positions with the rearmost (left hand) pocket being at the top. The elevation of each pocket 5, except of the foremost (right hand) one, is limited by its slidable connection to the adjacent pocket next in front, whereas the elevation of the foremost pocket is limited by its slidable connection to the front wall portion 21 of the casing member 6. In addition to the fact that the pockets will be guided, one by the other, the rearmost pockets is guided by being connected to the slide member 8, which through the coupling member 7 is slidably connected to the rear wall portion 20 of the casing member 6. The flap portions 41 and 31 extending along the lateral edges of the slide member 8 and the coupling member 7, respectively, prevent the objects received in the pockets 5 from sliding out laterally.

When the insert unit is received in the box 1, as shown in FIGS. 1 and 2, the total space for objects in the storing device is, of course, limited to a certain maximum, but there is nothing to prevent an unequal distribution of this total space between the various compartments formed by the pockets 5. This makes it possible not only to store objects of different thicknesses, or different numbers of objects of uniform thickness, in the various pockets but also to widen any one of the pockets in order to facilitate the insertion as well as the removal of the objects.

It should be readily understood that various modifications in the details of the storing device here shown and described are feasible in order to adapt it to various needs. Thus the size as well as the number of the pockets may be varied. If the number of the pockets is reduced so far that none of them will entirely leave the box when elevated, the intermediate coupling member 7 may be dispensed with and the slide member 8 be slidably coupled directly to the casing member 6.

I claim:

1. A device for storing flat objects comprising:

(A) a plurality of structurally identical, pocket-like receptacles for receiving the objects to be stored, each of them being formed by double-folding a generally rectangular blank of thin but stiff sheet material and having a front wall portion and a rear wall portion, the height of the latter exceeding that of the front wall portion, (a) said pocket-like receptacles being slidably interconnected in series, one to the next, in a manner to permit limited relative movement of them between a first, storing position, in which they are all located straight behind one another, and a second, stepped and partly exposed position, in which each receptacle behind projects vertically beyond the next adjacent receptacle in front a predetermined distance at least approximately corresponding to the difference in height between the front and rear wall portions of each receptacle;

(B) an inner cover enclosing said interconnected receptacles when they are in said first position but leaving them free to be moved into said second, partly exposed position, said inner cover including a fore wall member and a back wall member, both being of approximately the same size as said pocket-like receptacles, (b) the front wall portion of the foremost receptacle in said series of receptacles being connected to said fore wall member of said inner cover;

(C) a slide member, to which the rear wall portion of the rearmost receptacle in said series of receptacles is attached, (c) said slide member being connected to said back wall member of said inner cover in a manner to permit guided and limited vertical movement thereof in parallel relationship to said back wall member; and (D) an outer box-like case receiving said series of interconnected receptacles, said inner cover, and said slide member, and having an opening, through which said slide member together with at least some of said interconnected receptacles may be pulled out, (d) said inner cover being retained in said outer box-like case in a manner to form a lining therein; and wherein (E) the interconnection between adjacent receptacles is provided solely by means of interengaging tabs and slits formed in the two wall portions of each receptacle, the slits extending vertically therein and each tab being cut out integral with the respective wall portion in a manner to lie substantially in the plane thereof and to extend laterally into the corresponding slit of the next adjacent receptacle.

2. A storing device according to claim 1, wherein each wall portion of each pocket-like receptacle has one vertically extending slit and one laterally extending tab only, the tab of the front wall portion extending in the opposite direction to the tab of the rear wall portion.

3. A storing device according to claim 1, wherein said inner cover and said slide member are made of thin but stiff sheet materials, and wherein said slide member is slidably connected to said back wall member of said inner cover through an intermediate coupling member likewise made of a thin but stiff sheet material, said coupling member being slidably connected to both said slide member and to said back wall member in a manner to form an extension element between them.

4. A storing device according to claim 3, wherein the connection between said coupling member and said slide member, and said back wall member of said inner cover, respectively, is established by means of a pair of vertically extending slits in each of said slide member and said back wall member, and by means of laterally extending tabs cut out in said coupling member and integral therewith for engaging said slits.

* * * * *